United States Patent [19]

Nakamura et al.

[11] Patent Number: 4,901,394

[45] Date of Patent: Feb. 20, 1990

[54] FLOOR NOZZLE FOR ELECTRIC CLEANER

[75] Inventors: Kazuo Nakamura, Yohkaichi; Yoshitaka Murata, Shiga; Hiroshi Kawakami, Yohkaichi; Takemitu Okuma, Katano, all of Japan

[73] Assignee: Matsushita Electric Industrial Co., Ltd., Osaka, Japan

[21] Appl. No.: 339,114

[22] Filed: Apr. 17, 1989

[30] Foreign Application Priority Data

Apr. 20, 1988 [JP] Japan ..... 63-97100

[51] Int. Cl.[4] ..... A47L 5/30

[52] U.S. Cl. ..... 15/383; 15/364

[58] Field of Search ..... 15/383, 372, 366, 364

[56] References Cited

U.S. PATENT DOCUMENTS 862,053 7/1907 Cobb ..... 15/383 X 1,740,525 12/1929 Tyson ..... 15/383 X 1,919,067 7/1933 Lang et al. ..... 15/383

2,537,523 1/1951 Frost ..... 15/383 X 2,578,549 12/1951 Hooban ..... 15/344

4,445,245 5/1984 Lu ..... 15/383 X

FOREIGN PATENT DOCUMENTS 685208 12/1952 United Kingdom ..... 15/383

*Primary Examiner*—Chris K. Moore

*Attorney, Agent, or Firm*—Stevens, Davis, Miller & Mosher

[57] ABSTRACT

A floor nozzle for vacuum cleaner comprising: a floor nozzle body in which an agitator and a drive source are incorporated, the agitator includes a rotor provided on its outer peripheral surface with flexible lips made of polyurethane rubber added with talc as a reinforcing agent so as to have a rubber hardness of 50 to 70, and blended with 0.1 to 0.5% of a coloring agent.

4 Claims, 3 Drawing Sheets

FLOOR NOZZLE FOR ELECTRIC CLEANER

BACKGROUND OF THE INVENTION

1. Field of the Invention

The present invention relates to an agitator used in a floor nozzle for a vacuum cleaner.

2. Description of the Prior Art

In an agitator of this type, a brush is implanted along a circumferential surface of a rotor. Dust on a surface to be cleaned, for example, a carpet are scraped by the brush and are introduced into the floor nozzle by the suction of the electric cleaner. However, string-like dust such as lint is entrained around the brush and becomes entangled around the overall agitator to degrade its desired function. Also, the removal of the string is troublesome and labourious.

In order to cope with this problem, instead of the brush implanted along the circumferential surface of the rotor of the agitator, there has been proposed a structure in which lips each having a number of projections on at least one surface thereof and made of molding materials such as soft vinyl chloride resin or the like, or flexible materials such as chloroprene rubber or the like are provided around the circumferential surface of the rotor. With this arrangement, it has been possible to eliminale a problem of lint entangled around the circumferential surface of the rotor, but the lips which are made of soft chloride vinyl resin wear out in a relative short time. Thus, there is a problem in durability. Also, if the lips are made of chloroprene rubber or the like, carbon black which has been added thereto in order to reinforce the rubber contaminates the floor surface with a black color. Thus the prior art cleaner has suffered from various problems.

SUMMARY OF THE INVENTION

In order to overcome the above-noted defects, according to the present invention, lips made of molding material in which talc is blended serving as both reinforcement and friction reducing agent with vulcanized polyurethane rubber are formed on the circumferential surface of a rotor to form an agitator.

A number of projections are formed on at least one surface (which extends in the rotational direction) of the lips of the agitator. In addition, the lips are formed of molding materials such as vulcanized urethane rubber or the like having excellent flexibility and repulsive property. Therefore, the lips are well fit for a surface to be cleaned when the lips are brought into contact with the surface. The lips serve to well rub the surface to be cleaned. As a result, dust is freed from the surface to be cleaned and is sucked into a floor nozzle body with a high degree of efficiency under suction of the cleaner and the restoring force of the lips. Several projections are formed on a tip end portion of each lip, which are rotated in sliding contact with the surface to be cleaned, such as a carpet, under pressure. Due to the action of the talc or the like added to the lip as a reinforcement or friction-reducer and the usage of the vulcanized polyurethane rubber excellent in durability against friction, it is possible to keep sufficient dust collecting performance and a long service life without contamination of the floor with black agents.

Also, since the hardness of each lip is set to a value from 50 to 70, when the lip is brought into contact with the surface to be cleaned, the suitable fit phenomenon occurs in an optimum condition on the surface, to thereby effectively rub the surface. Therefore, the dust collecting performance on the surface to be cleaned is further enhanced. Furthermore, since an extremely small amount of rubber coloring agent such as carbon black to an extent of 0.1 to 0.5% is added into the vulcanized polyurethane rubber blended with talc to give a slight color to the rubber, there is no fear that the floor surface would be contaminated by such a coloring agent. Spotted burns or contamination generated during the molding operation would not be remarkable to effectively enhance an aesthetic appearance.

BRIEF DESCRIPTION OF THE DRAWINGS

Other objects, features, and advantages of the present invention will become more apparent by the following description taken in conjunction with the accompanying drawing in which.

DETAILED DESCRIPTION OF THE PREFERRED EMBODIMENTS

Figure 1:
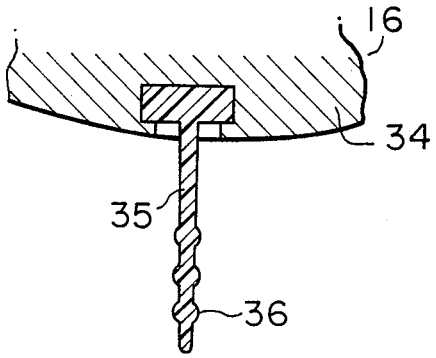
FIG. 1 is a cross-sectional view illustrating an essential part of an agitator which is one embodiment of the invention.
Figure 4:
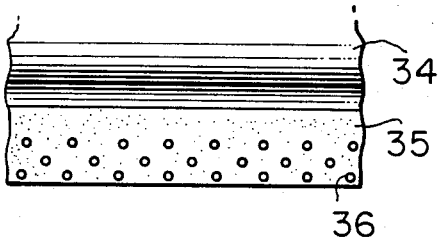
FIG. 4 is a side elevation view illustrating the essential part of the agitator.

The present invention will now be described with reference to the accompanying drawings.

Referring now to FIGS. 1 to 4 there is shown a floor nozzle body 7 composed of upper and lower body members 9 and 10 which are coupled together through the intermediary of a bumper 8. A suction chamber 12 having a lower opening as a suction port 11 is formed in a front inner portion of the nozzle body 7, and a turbine chamber 13 is formed in a rear inner portion of the nozzle body 7. The turbine chamber 13 is separated from the suction chamber 12 by a partition wall 14. Also, its rear portion having an opening 15 is formed in an arcuate shape. An agitator 16 is arranged in parallel with the suction chamber 12 within the suction chamber 12. A pair of bearings 17 are provided for the agitator 16 on opposite side walls of the suction chamber 12. A stationary brush 18 is arranged in the rear of the suction port 11 in parallel therewith. Wheels 19 and 20 are provided to front and rear portions of the floor nozzle body 1, so as to obtain a predetermined space between the floor nozzle body 1 and the floor to be cleaned.

A substantially semicylindrical suction joint 21 is slidably and rotatably arranged on the inner rear surface of the turbine chamber 13. A floor nozzle pipe 24 is rotatably fitted on a cylindrical connection port 22 projected from a part of the circumferential wall of the suction joint 21 through the intermedialy of a ring 23. Also, an extension tube which is communicated to the suction side of the vacuum cleaner through a hose is detachably connected to the floor nozzle pipe 24.

A turbine 25 is arranged in the turbine chamber 13 and partially surrounded by the suction joint 21 along the circumference of the turbine. A shaft 26 is integrally formed with the turbine 25 and passed through the suction joint 21 on one side.

A power transmission belt 27 is used to transmit the rotation of the turbine 25 to the agitator 16 through a pulley 28.

Also, the turbine 25 is set aside to the belt 27 within the turbine chamber 13. Vent holes 29 and 30 are formed in the partition wall 14, one vent hole 29 being confronted by the lower half portion of the turbine 25 and the other vent hole 30 being not confronted by the turbine 25 but directly by the connection port 22 of the suction joint 21.

A switching lever 31 has a shielding plate 32 extending from a part of the switching lever 31, and formed therein with an opening 33 adapted to be selectively communicated with one of the vent ports 29, 30.

Figure 2:
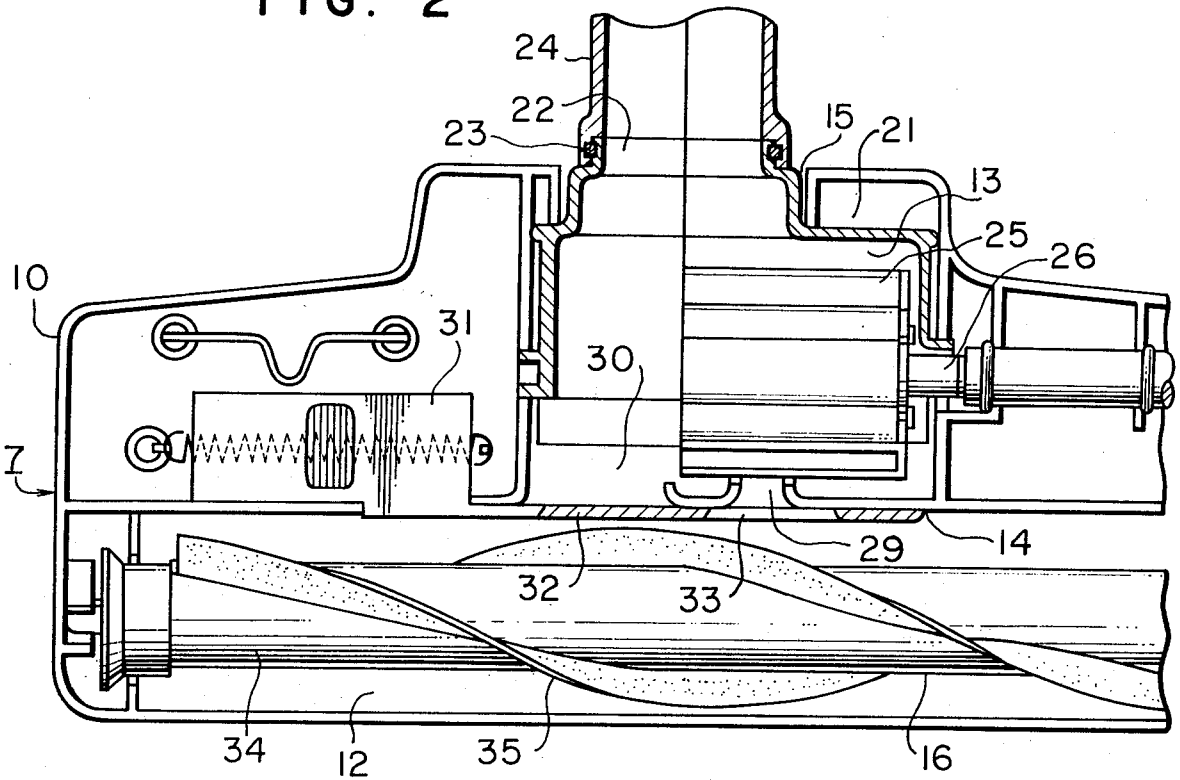
FIG. 2 is a plan view illustrating a floor nozzle from which an upper body portion has been removed.
Figure 3:
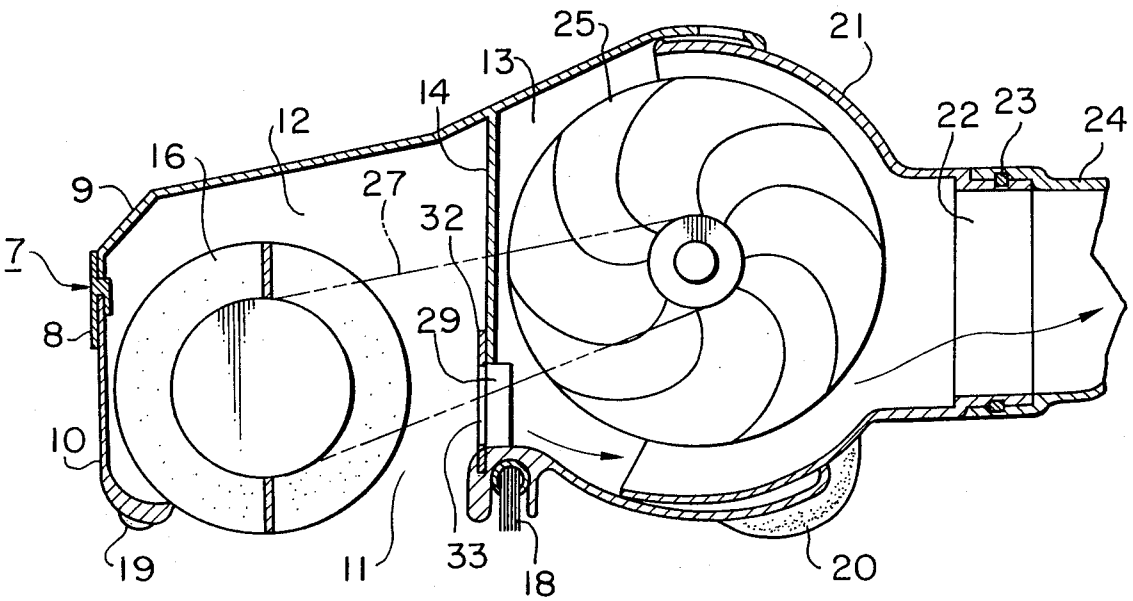
FIG. 3 is a cross-sectional view illustrating the floor nozzle shown in FIG. 2.

In the foregoing structure, when the switching lever 31 is slid to the right in FIG. 2 so as communicate the opening 33 of the shielding plate 32 with the vent hole 29, the suction air that has been introduced from the suction port 11 through the suction chamber 12 and the vent port 29 collides against the turbine 25. Subsequently the air flows through the connection port 22 of the suction joint 21, the floor nozzle pipe 24, the extension tube and the hose to the vacuum cleaner. Therefore, the turbine 25 is rotated and its rotational power is transmitted to the agitator 16.

It should be noted that the agitator 16 is formed with spiral lips 35 along the longitudinal outer direction of the rotor 34. Each lip 35 is made of flexible material such as vulcanized urethane rubber and is provided with a number of projections 36 on at least one surface thereof (surface in the rotational direction).

Figure 5:
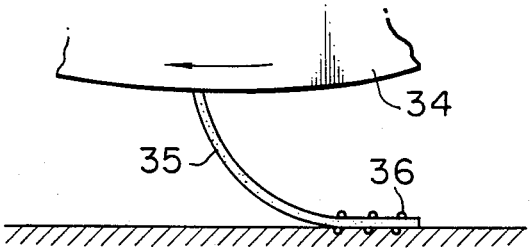
FIG. 5 is a view illustrating operation of the agitator.

When the agitator 16 is rotated in the clockwise direction as shown in FIG. 5, the lip 35 is shifted in the opposite direction to the rotational direction at the position contact with the surface to be cleaned and is deformed in conformity with the surface to be cleaned. Thereafter, the lip 35 skips relative to the surface to be cleaned while rubbing the surface. At this time, the dust is rubbed by the projections 36 of the lip so as to be removed away from the surface to be cleaned.

The free dust is effectively introduced into the floor nozzle body 7 by the suction force of the vacuum cleaner and the repulsive force effected when the lip 35 is restored in the radial direction (due to the flexibility and centrifugal force).

The lip 35 is used to interrupt the flow of the air from the front side when it is brought into contact with the surface to be cleaned, whereby the suction force of the vacuum cleaner is concentrated on the surface to be cleaned and acts thereon with the assistance of the lip 35.

Also, since the lip 35 is in the form of a band, it is possible to prevent strings or the like from being entangled around the lip.

As described above, the lips 35 each mounted in the circumferential and longitudinal direction of the rotor 34 serve to remove dust away from the surface to be cleaned and to impart the repulsive action to the dust. These lips are the basic members for determining the dust collection performance.

During the use of the floor nozzle, the agitator is rotated at a high speed of 3,000 to 4,000 rpm, is brought into press contact with the carpet surface and is reciprocatingly moved back and forth. The agitator must have a durability over five years under the above-mentioned use. It is also necessary to ensure the durable service life of the lips over 500 hours. In order to meet this requirement, the lips should have the following properties:

I. The melting resistance and wear resistance must be considerably high.

II. The lips must fit the surface to be cleaned and their surfaces have the function to rub the carpet surface. The lips need the repulsive property and restoring property. The lips must have flexibility and high repulsive performance.

III. The lips do not have contamination property to the floor surface.

It would be possible to use the molding material such as natural rubber, chloroprene rubber, nitrile rubber or the like for the lips that meet the above-described requirement. However, if white carbon is used as reinforcement for these general rubbers, the requirements would not be met. Thus, it is necessary to use carbon black having a high reinforcement effect. In this case, however if the lips are rubbed on the floor surface, the black contamination phenomenon would be generated on the floor to raise a serious problem.

According to the invention, vulcanized polyurethane rubber is used as the molding material in order to meet all the requirements. Since the vulcanized polyurethane rubber sufficiently meets the practical strength without using carbon black as the reinforcement, there is no fear that the floor surface would be contaminated by black color. However, since the lips needs melting resistance and friction resistance and must be used in a particularly severe condition, 30 to 60 parts of talc is added into 100 parts of vulcanized polyurethane rubber in order to reduce the friction coefficient and to enhance the reinforcement effect, thereby ensuring long service life of the floor nozzle over five years and the durability of the lips over 500 hours.

It is a matter of course to ensure the durability of the floor nozzle. It is one of the most important factors to increase the dust removing performance on the surface to be cleaned. For this reason, the function of the lips mounted on the surface of the rotor of the agitator is important.

When the lips are brought into contact with the surface to be cleaned, the lips must fit the surface to free dust away from the surface and to introduce the freed dust into the floor nozzle body by the restoring force of the lips. Thus, the lips must have high elasticity, a high creep characteristic and high flexibility. The hardness thereof is preferably in a range of 50 to 70. This hardness is measured under Durometer hardness, shore A of ASTM D-2240.

Also, if the lips are white, the molded surfaces thereof are liable to be inferior in appearance due to spotted burrs, contamination or the like, causing the non-acceptable product rate. To increase polyurethane rubber suffers from such a disadvantage that the color thereof is changed by ultraviolet rays. Therefore, for example, 0.1 to 0.5% carbon black or the like is added as a coloring pigment to color the rubber, whereby the appearance defect rate is considerably reduced and the weather color change may be prevented with no contamination of the floor surface.

The examples of the blending rates of the molding material and vulcanized polyurethane rubber for the lips according to the invention will be listed below:

| Blended Agents | Blending amount (Parts) |
|---|---|
| polyether modified urethane rubber | |

-continued

| Blended Agents | Blending amount (Parts) |
|---|---|
| Takenate E-3000 | 100 |
| talc, crown talc | 30 to 60 |
| titanium oxide | 5 to 15 |
| zinc stearin acid | 0.1 to 1.0 |
| coloring carbon FEF class | 0.1 to 0.5 |
| vulcanization accelerator M | 0.5 to 2.5 |
| vulcanization accelerator DM | 0.5 to 2.5 |
| vulcanization accelerator PZ | 0.5 to 2.0 |
| active trimethyrol propane, trimethacrylate | 0.5 to 2.0 |
| sulfur 200 meshed powder | 1.0 to 1.5 |
| Vulcanization Condition | |
| temperature: 110 to 150° C. | |
| period: 8 to 30 minutes | |
| pressure: 20 to 50 kg/cm$^2$ | |

The physical property of the vulcanized polyurethane rubber used for the lips molded under the above-described condition is as follows (ASTM D-2240, Durometer Hardness, Shore A):

tensile strength: 200 to 300 kg/cm$^2$
elongation hardness: 500 to 700%
rubber hardness: 55 to 65
shearing strength: 30 to 50 kg/cm$^2$
friction index [(decreased weight/original total weight)x100]: 0.1 to 3.0%

As has been apparent from the above description, according to the present invention, the vulcanized polyurethane rubber is used as a molding material for the lips provided in the longitudinal direction of the rotor circumferential surface of the agitator, and 30 to 60 parts of talc is added to the polyurethane rubber (100 parts) as additives.

As a result, the vulcanized polyurethane rubber satisfies the practical strength with no use of carbon black which is essential in natural rubber and chloroprene rubber. Thus, there is no fear that the floor surface would be contaminated with black. Also, the lips requires high melting resistance and wear resistance and must endures under severe conditions in use. Therefore, although it is sufficient to have wear resistance alone for the vulcanized polyurethane rubber alone, the present invention proposes that talc is added to vulcanized polyurethane rubber thereby considerably reducing the friction coefficient and surely enhancing the service life.

The hardness of the lips is set in the range of 50 to 70 (ASTM D-2240, Durometer Hardness, Shore A). As a result, when the lips are brought into contact with the surface to be cleaned, the lips fit the surface under an optimum condition to remove the dust away from the surface and to introduce, with ease, the removed dust by the restoring force of the lips so as to considerably enhance the dust removing efficiency.

Since the vulcanized polyurethane rubber which is white and added with the talc is used as the molding material for the lips, the lips are inferior in resistance of weather discoloration such as yellow discoloration by ultraviolet rays, and it requires severe management in molding ability since the appearance defect rate is liable to be increased due to spotted burns or contamination during the molding process. However, according to the invention a small amount of coloring agent such as carbon black is added by 0.1 to 0.5% to color the lips slightly. This does not cause the floor contamination and makes it possible to improve the above-mentioned disadvantages.

WHAT IS CLAIMED IS:

1. A floor nozzle for a vacuum cleaner, comprising:
a floor nozzle body;
an agitator incorporated in said floor nozzle body and having a rotor provided on its outer peripheral surface with flexible lips, and
a drive source incorporated in said nozzle floor body, for driving said agitator,
said lips being made of a material in which 30 to 60 parts of talc is added to 100 parts of vulcanized polyurethane.

2. A floor nozzle as set forth in claim 1, wherein said lips have a hardness in a range of 50 to 70 shore A, ASTM D-2290 Durometer Hardness

3. A floor nozzle as set forth in claim 1, wherein said lips are colored with 0.1 to 0.5% of a rubber coloring agent.

4. A floor nozzle as set further in claim 1, wherein several projections are formed on at least one surface of each of said lips.

* * * * *

UNITED STATES PATENT AND TRADEMARK OFFICE

CERTIFICATE OF CORRECTION

PATENT NO. : 4,901,394

DATED : Feb. 20, 1990

INVENTOR(S) : Kazuo Nakamura, et al.

It is certified that error appears in the above-identified patent and that said Letters Patent is hereby corrected as shown below:

On the title page, item [73], add a second assignee's name as shown below:

--NATIONAL TIRE COMPANY, LTD--.

Signed and Sealed this

Eleventh Day of June, 1991

*Attest:*

HARRY F. MANBECK, JR.

*Attesting Officer*

*Commissioner of Patents and Trademarks*